United States Patent [19]

Matsuda et al.

[11] Patent Number: 4,866,267

[45] Date of Patent: Sep. 12, 1989

[54] DOUBLE-FOCUSING MASS SPECTROMETER HAVING WIEN FILTER AND MS/MS INSTRUMENT USING SUCH SPECTROMETER

[75] Inventors: Hisashi Matsuda, Hyogo; Motohiro Naito, Tokyo, both of Japan

[73] Assignee: JEOL Ltd., Tokyo, Japan

[21] Appl. No.: 180,305

[22] Filed: Apr. 12, 1988

[30] Foreign Application Priority Data

Apr. 15, 1987 [JP] Japan ..... 62-92604

[51] Int. Cl.[4] ..... H01J 49/32

[52] U.S. Cl. ..... 250/296; 250/281

[58] Field of Search ..... 250/281, 282, 283, 294, 250/295, 296, 297

[56] References Cited

U.S. PATENT DOCUMENTS

| | | | |
|---|---|---|---|
| 3,885,155 | 5/1975 | Anbar | 250/283 |
| 4,022,876 | 5/1977 | Anbar | 250/282 |
| 4,472,631 | 9/1984 | Enke et al. | 250/287 |
| 4,521,687 | 6/1985 | Naito | 250/282 |
| 4,536,652 | 8/1985 | Cooks et al. | 250/282 |
| 4,553,029 | 11/1985 | Matsuda | 250/296 |
| 4,588,889 | 5/1986 | Naito | 250/295 |
| 4,645,928 | 2/1987 | Naito | 250/282 |
| 4,694,169 | 9/1987 | Uchida | 250/396 R |

*Primary Examiner*—Bruce C. Anderson

*Attorney, Agent, or Firm*—Webb, Burden, Ziesenheim & Webb

[57] ABSTRACT

A double-focusing mass spectrometer comprising a Wien filter and a homogeneous magnetic field. Daughter ions produced from parent ions of a certain ionic species differ in mass but have velocities substantially equal to that of the parent ions. The Wien filter is set up such that the velocities of the daughter ions satisfy the Wien condition. Thus, the daughter ions originated from the specified parent ions pass through the filter and are dispersed according to mass by the homogeneous magnetic field and focused into a focal plane. A two-dimensional ion detector is disposed along this focal plane in order to simultaneously detect said daughter ions and to obtain a spectrum of the daughter ions.

2 Claims, 4 Drawing Sheets

DOUBLE-FOCUSING MASS SPECTROMETER HAVING WIEN FILTER AND MS/MS INSTRUMENT USING SUCH SPECTROMETER

BACKGROUND OF THE INVENTION

The present invention relates to a double-focusing mass spectrometer having a Wien filter and an instrument using such a mass spectrometer as its second mass-selective device for conducting mass spectrometry (MS)/mass spectrometer (MS).

Mass spectrometry involving detecting daughter ions dissociated from parent ions in a field-free region is quite useful in elucidating the molecular structures of complex organic compounds. Heretofore, such spectrometry has been carried out by either linked scan method where the electric field and the magnetic field of a double-focusing mass spectrometer are varied in an interrelated manner, or a MS/MS method using tandem arrangement of two mass spectrometers.

In a linked scan method, daughter ions dissociated from metastable ions in the field-free region between an ion source and an electric field are detected. When metastable ions dissociated into daughter ions, it is thought that the daughter ions travel at the same velocity as the parent ions. The kinetic energy of a particle having a mass of m and a velocity of v is given by $mv^2/2$ and, therefore, produced daughter ions possess kinetic energies proportional to their masses. For this reason, the energy of the daughter ions lie in a wide range.

When such a group of daughter ions is analyzed with a conventional double-focusing mass spectrometer having a cylindrical electric field and a magnetic sector, daughter ions which can pass through the cylindrical field are only ions having energies lying within about +5% of a given value, or within an energy range of about 10%. Consequently, the linked scan method, in which the two fields are varied in an interrelated manner, is adopted for enabling mass analysis of daughter ions having a wide range of energies, i.e., a broad range of masses.

In conducting MS/MS, the first mass spectrometer sorts out only parent ions having a given mass. The parent ions dissociate into daughter ions in the field-free region between the first and second mass spectrometers. The resulting daughter ions are introduced into the second mass spectrometer and a mass spectrum of the daughter ions is obtained.

Where a conventional double-focusing mass spectrometer which consists of a cylindrical electric field and a magnetic sector is employed as the second mass selective device to obtain daughter-ion spectra with high resolution, since daughter ions possess a wide range of energies, a linked scan method must be adopted.

In this way, when daughter ions are analyzed by a double-focusing mass spectrometer having a cylindrical electric field and a magnetic field, it has been heretofore imperative that both fields be altered in an interrelated way. Where both fields are scanned in this fashion to provide a spectrum, all ions not impinging on the ion detector are eliminated. This leads to a deterioration in the sensitivity. Hence, there is a limit to enhancement of the sensitivity.

SUMMARY OF THE INVENTION

It is an object of the invention to provide a double-focusing mass spectrometer which can obtain daughter-ion spectra with high sensitivity by simultaneously detecting daughter ions having a wide range of energies.

It is another object of the invention to provide an instrument which is used in MS/MS method, said instrument employing the novel double-focusing mass spectrometer according to the present invention as its second mass-selective device to obtain spectra of daughter ions having a wide range of masses with high sensitivity.

According to one embodiment of this invention, there is provided a double-focusing mass spectrometer comprising an ion source for producing ions and a baffle having a source slit through which ions from said source pass. From the baffle the ions pass to a Wien filter that receives the ions transmitted through the slit to a mass-selective magnetic field. Beyond the mass-selective field is positioned a two-dimensional ion detector on which ions exiting from the magnetic field impinge. The detector is disposed along a plane where the double-focusing condition substantially holds for a group of daughter ions having a range of masses and being dissociated from parent ions of a certain ionic species.

According to another embodiment of this invention, there is provided an instrument comprising an ion source; a first mass spectrometer into which ions from said source are introduced; and a means for dissociating the parent ions selected by the first mass spectrometer. A Wien filter receives daughter ions produced by dissociation of the parent ions. A mass-selective magnetic field receives ions emerging from the filter. Beyond the mass-selective field is positioned a two-dimensional ion detector on which ions exiting from the magnetic field impinge. The detector is disposed along a plane where the double-focusing condition substantially holds for a group of daughter ions having a range of masses and being dissociated from parent ions of a certain ionic species.

BRIEF DESCRIPTION OF THE DRAWINGS

Other objects and features of the invention will appear in the course of the following description made with reference to the drawings in which.

DESCRIPTION OF THE PREFERRED EMBODIMENTS

Figure 1:
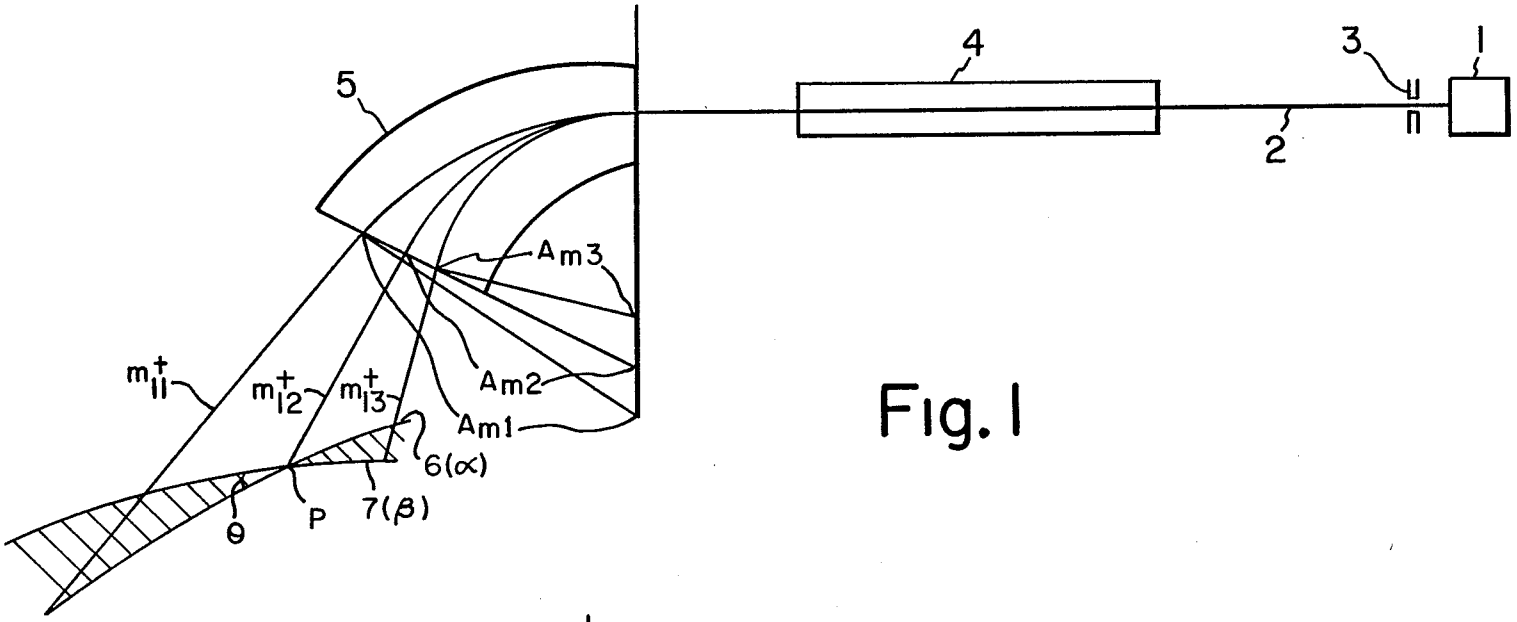
FIG. 1 is a schematic diagram of a double-focusing mass spectrometer according to the invention.

Referring to FIG. 1, there is shown a double-focusing mass spectrometer embodying the concept of the invention. The spectrometer includes an ion source 1 for producing ions 2 to which a predetermined energy is equally given. The ions 2 then pass through a source slit 3 and enters a Wien filter 4. Ions transmitted through the filter 4 are spatially separated by a homogeneous magnetic field 5 according to mass.

The novel double-focusing mass spectrometer is characterized in that it uses the Wien filter 3 instead of a conventional cylindrical electric field. This filter makes use of an electric field E and a magnetic field B which are superimposed at right angles to each other. When ions travel at velocity v in a direction perpendicular to both fields, a force Fe (=eE) by the electric field, and a force Fm (=eVB) by the magnetic field act on said ions. If the directions and intensities of the fields are so adjusted that these two forces cancel out, the ions travel straight and can pass through the Wien filter. The Wien condition for permitting ions to pass through is given by $$Fe+FM=eE+eVB=0V=-E/B \quad (1)$$

It can be seen from equation (1) that the requirement depends solely on the velocities of ions and is independent of the masses of them.

Referring still to FIG. 1, a field-free region exists between the source slit 3 and the Wien filter 4. It is now assumed that parent ions $m_1^+$, $m_2^+$ and $m_3^+$ with respective velocities $v_1$, $v_2$ and $v_3$ are produced in the ion source 1, and they dissociate into three groups of daughter ions as follows:

| Parent ion | velocity | daughter ions | velocity |
|---|---|---|---|
| $m_1^+$ | $v_1$ | $m_{11}^+$, $m_{12}^+$, $m_{13}^+$ | $v_1$ |
| $m_2^+$ | $v_2$ | $m_{21}^+$, $m_{22}^+$, $m_{23}^+$ | $v_2$ |
| $m_3^+$ | $v_3$ | $m_{31}^+$, $m_{32}^+$, $m_{33}^+$ | $v_3$ |

If the velocity $v_1$ meets the Wien condition, only the daughter ions $m_{11}^+$, $m_{12}^+$ and $m_{13}^+$ from the parent ions $m_1^+$ can pass through the Wien filter 4. Other ions having velocities $v_2$ or $v_3$ do not cater for the Wien condition and cannot pass through the filter 4.

The daughter ions $m_{11}^+$, $m_{12}^+$, $m_{13}^+$ emerge from the filter 4 and are dispersed at different radii of curvature $A_m$ according to mass by the homogeneous magnetic field 5. The separated ions are focused into a focal plane. FIG. 1 shows the central paths of the daughter ions different radii of curvature $A_{m1}$–$A_{m3}$.

The focal plane is divided into an angular focal plane 6 and a velocity focal plane 7, which will hereinafter be referred to as the $\alpha$ focal plane and the $\beta$ focal plane, respectively. These two focal planes intersect at a point P where the double-focusing condition holds. Where the angle $\theta$ formed between the focal planes is small, it can be considered that the double-focusing condition substantially holds in the region between the focal planes, the region being hatched. Therefore, a group of daughter ions produced from parent ions of one ionic species can be simultaneously detected while fulfilling the double-focusing condition, by placing a two-dimensional ion detector along the region between the focal planes, the detector being capable of spatially resolving ions.

Figure 2:
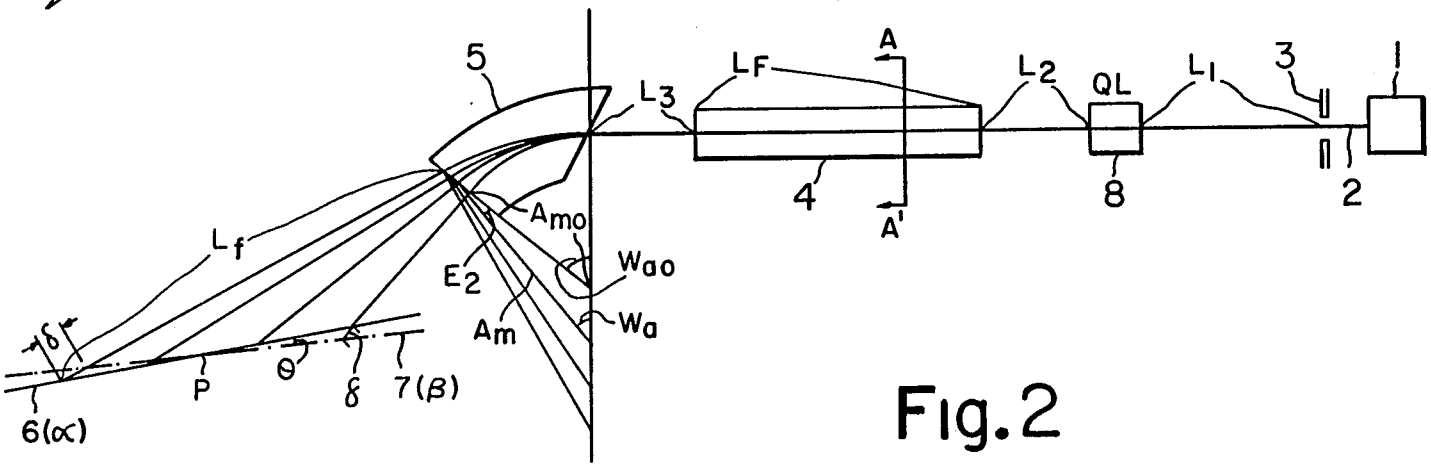
FIG. 2 is a schematic diagram of a double-focusing mass spectrometer according to the invention.

FIG. 2 shows a double-focusing mass spectrometer using a Wien filter according to the invention. It is to be noted that like components are denoted by like reference numerals in various figures.

Figure 3:
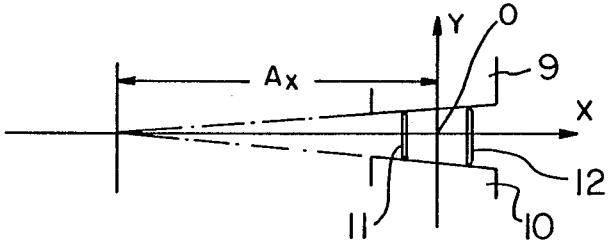
FIG. 3 is a cross-sectional view taken along line A–A' of FIG. 2.

As shown in FIG. 2, a quadrupole lens 8 is positioned in the ion path between the source slit 3 and the Wien filter 4. In FIG. 3, the Wien filter 4 comprises magnetic pole pieces 9 and 10 and electrodes 11 and 12 for setting up an electric field. The magnetic pole pieces 9 and 10 are disposed symmetrically with respect to the central ion path O. The electrodes 11 and 12 are located between the pole pieces 9 and 10 and in a symmetrical relation with respect to the path 0. As shown, the opposite faces of the two magnetic pole pieces are not perfectly parallel to each other but so inclined that they intersect with the central plane at points which are $A_x(=1/Px)$ distant from the central orbit O.

The trajectories that ions traveling through the mass spectrometer shown in FIG. 2 are calculated in the manner described below. Today the calculation of an ion orbit is performed using a computer. Various factors of an ion are represented vectorially. The horizontal position, the horizontal angle, the mass, the velocity, the vertical position, and the vertical angle of the ion are indicated by X, $\alpha_r$, $\gamma$, $\beta$, Y, $\alpha_z$, respectively. The field acting on this ion is expressed as a transformation matrix.

The mass $\gamma$ and the velocity $\beta$ are kept constant, though the ion is acted on by the field. The horizontal position X, the horizontal angle $\alpha_r$, the vertical position Y, and the vertical angle $\alpha_z$ undergo transformation by the action of the field. Among them, the horizontal position X and the vertical position Y affect focusing.

When the ion lies in a focal plane, it is given by ($X_F$, $\alpha_{\chi F}$, $\gamma$, $\beta$, $Y_F$, $\alpha_{z,F}$). Under the initial condition, the ion located at the position of the source slit is given by (X, $\alpha_\chi$, $\gamma$, $\beta$, y, $\alpha_z$). $X_F$,$\alpha_{\chi,F,F}$, $Y_F$, and $\alpha_{z,F}$ can be expanded to the first-order approximation as follows:

$$X_F=X_\chi+A\alpha_\chi+S\beta+C\gamma+ \quad (2)$$

$$\alpha_{\chi'F}=X'_\chi+A'\alpha_\chi+S'\beta+C'\gamma+ \quad (3)$$

$$Y_F=Y_Y+B\alpha_z \quad (4)$$

$$\alpha_{z'F}=Y'Y+B'\alpha_z \quad (5)$$

The coefficients X, A, S, C, Y, B, X', A', S', C', Y', B' included in equations (2)–(5) are calculated. Then, the characteristics of convergence of ions can be estimated from the value of these coefficients.

Tables 1–4 given below provide four examples of the mass spectrometer. The dimensions of the components differ among these examples. In each table, the calculated values of the coefficients are listed for six ion paths (1)–(6) corresponding to six different radii of curvature $A_m$.

TABLE 1

LF = 2.7 Px = 0.80 MR = 1.5 QK = 0.01 QL = 0.2 $L_1$ = 1.2 $L_2$ = 0.4 $L_3$ = 0.3 $\omega_{go}$ = 50° $\epsilon_1$ = −20° $\omega_g - \epsilon_2$ = 50°

| | (1) | (2) | (3) | (4) | (5) | (6) |
|---|---|---|---|---|---|---|
| Am | 1.3 | 1.4 | 1.5 | 1.6 | 1.7 | 1.8 |
| X | −0.269 | −0.295 | −0.323 | −0.354 | −0.387 | −0.423 |
| A | 0 | 0 | 0 | 0 | 0 | 0 |
| S | −0.132 | −0.084 | −0.043 | −0.007 | 0.024 | 0.052 |
| C | 1.213 | 1.294 | 1.372 | 1.448 | 1.523 | 1.599 |
| Y | −2.330 | −2.402 | −2.463 | −2.514 | −2.558 | −2.598 |

TABLE 1-continued

LF = 2.7 Px = 0.80 MR = 1.5 QK = 0.01 QL = 0.2 $L_1$ = 1.2
$L_2$ = 0.4 $L_3$ = 0.3 $\omega_{ao}$ = 50° $\epsilon_1$ = −20° $\omega_a - \epsilon_2$ = 50°

| | (1) | (2) | (3) | (4) | (5) | (6) |
|---|---|---|---|---|---|---|
| B | −1.705 | −1.344 | −0.943 | −0.507 | −0.041 | 0.452 |
| X' | −1.042 | −0.964 | −0.891 | −0.824 | −0.762 | −0.706 |
| A' | −3.720 | −3.394 | −3.096 | −2.827 | −2.583 | −2.363 |
| S' | 1.506 | 1.278 | 1.095 | 0.946 | 0.823 | 0.720 |
| C' | 0.599 | 0.561 | 0.528 | 0.500 | 0.475 | 0.453 |
| Y' | −0.869 | −0.832 | −0.792 | −0.751 | −0.711 | −0.672 |
| B' | −1.065 | −0.882 | −0.709 | −0.549 | −0.402 | −0.268 |
| $L_f$ | 1.523 | 1.796 | 2.079 | 2.371 | 2.677 | 2.996 |
| $\omega$ | 39.82° | 37.36° | 35.21° | 33.31° | 31.61° | 30.09° |
| $\epsilon_2$ | −10.18° | −12.64° | −14.79° | −16.69° | −18.39° | −19.91° |
| $Y_1$ | −0.348 | −0.280 | −0.218 | −0.161 | −0.109 | −0.062 |
| $B_1$ | 0.868 | 1.080 | 1.272 | 1.445 | 1.603 | 1.747 |
| $Y_2$ | −1.007 | −0.907 | −0.816 | −0.732 | −0.656 | −0.585 |
| $B_2$ | −0.083 | 0.240 | 0.532 | 0.796 | 1.036 | 1.253 |

TABLE 2

LE = 2.6 Px = 0.80 MR = 1.5 QK = 0.01 QL = 0.2 $L_1$ = 0.8
$L_2$ = 0.4 $L_3$ = 0.2 $\omega_{ao}$ = 50° $\epsilon_1$ = −20° $\omega_a - \epsilon_2$ = 50°

| | (1) | (2) | (3) | (4) | (5) | (6) |
|---|---|---|---|---|---|---|
| Am | 1.2 | 1.3 | 1.4 | 1.5 | 1.6 | 1.7 |
| X | −0.303 | −0.334 | −0.368 | −0.406 | −0.447 | −0.491 |
| A | 0 | 0 | 0 | 0 | 0 | 0 |
| S | −0.152 | −0.094 | −0.045 | −0.002 | 0.037 | 0.071 |
| C | 1.172 | 1.267 | 1.357 | 1.444 | 1.531 | 1.618 |
| Y | −2.089 | −2.172 | −2.244 | −2.305 | −2.360 | −2.409 |
| B | −0.620 | −0.253 | 0.158 | 0.606 | 1.088 | 1.601 |
| X' | −1.060 | −0.981 | −0.905 | −0.835 | −0.771 | −0.712 |
| A' | −3.300 | −2.994 | −2.715 | −2.464 | −2.238 | −2.035 |
| S' | 1.541 | 1.292 | 1.095 | 0.936 | 0.808 | 0.702 |
| C' | 0.644 | 0.599 | 0.561 | 0.528 | 0.500 | 0.475 |
| Y' | −0.850 | −0.818 | −0.779 | −0.738 | −0.697 | −0.657 |
| B' | −0.731 | −0.555 | −0.391 | −0.240 | −0.102 | 0.022 |
| $L_f$ | 1.328 | 1.612 | 1.907 | 2.215 | 2.537 | 2.877 |
| $\omega_a$ | 42.7° | 39.8° | 37.4° | 35.2° | 33.3° | 31.6° |
| $\epsilon_2$ | −7.33° | −10.18° | −12.64° | −14.79° | −16.67° | −18.39° |
| $Y_1$ | −0.293 | −0.222 | −0.157 | −0.099 | −0.046 | 0.003 |
| $B_1$ | 1.037 | 1.225 | 1.392 | 1.542 | 1.678 | 1.801 |
| $Y_2$ | −0.961 | −0.854 | −0.758 | −0.670 | −0.591 | −0.518 |
| $B_2$ | 0.351 | 0.643 | 0.903 | 1.137 | 1.348 | 1.539 |

TABLE 3

LF = 2.7 Px = 0.80 MR = 1.5 QK = 0.01 QL = 0.2 $L_1$ = 1.2
$L_2$ = 0.4 $L_3$ = 0.3 $\omega_{ao}$ = 50° $\epsilon_1$ = −20° $\omega_a - \epsilon_2$ = 50°

| | (1) | (2) | (3) | (4) | (5) | (6) |
|---|---|---|---|---|---|---|
| Am | 1.3 | 1.4 | 1.5 | 1.6 | 1.7 | 1.8 |
| X | −0.269 | −0.295 | −0.323 | −0.354 | −0.387 | −0.423 |
| A | 0 | 0 | 0 | 0 | 0 | 0 |
| S | −0.132 | −0.084 | −0.043 | −0.701 | 0.024 | 0.052 |
| C | 1.213 | 1.294 | 1.372 | 1.448 | 1.523 | 1.599 |
| Y | −2.330 | −2.402 | −2.463 | −2.514 | −2.558 | −2.600 |
| B | −1.705 | −1.344 | −0.943 | −0.507 | −0.041 | 0.452 |
| X' | −1.042 | −0.964 | −0.891 | −0.824 | −0.762 | −0.706 |
| A' | −3.720 | −3.394 | −3.096 | −2.827 | −2.583 | −2.363 |
| S' | 1.506 | 1.278 | 1.095 | 0.946 | 0.823 | 0.720 |
| C' | 0.599 | 0.561 | 0.528 | 0.500 | 0.475 | 0.453 |
| Y' | −0.869 | −0.832 | −0.792 | −0.751 | −0.711 | −0.672 |
| B' | −1.065 | −0.882 | −0.709 | −0.549 | −0.402 | −0.268 |
| $L_f$ | 1.523 | 1.796 | 2.079 | 2.371 | 2.677 | 2.996 |
| $\omega_a$ | 39.8° | 37.4° | 35.2° | 33.3° | 31.6° | 30.1° |
| $\epsilon_2$ | −10.18° | −12.64° | −14.79° | −16.69° | −18.39° | −19.91° |
| $Y_1$ | −0.348 | −0.280 | −0.218 | −0.161 | −0.109 | −0.062 |
| $B_1$ | 0.868 | 1.080 | 1.272 | 1.445 | 1.603 | 1.747 |
| $Y_2$ | −1.007 | −0.907 | −0.816 | −0.732 | −0.656 | −0.585 |
| $B_2$ | −0.083 | 0.240 | 0.532 | 0.796 | 1.036 | 1.255 |

TABLE 4

LF = 2.5 PX = 0.80 MR = 1.4 QK = 0.01 QL = 0.2 $L_1$ = 1.0
$L_2$ = 0.4 $L_3$ = 0.3 $\omega_{ao}$ = 50° $\epsilon_1$ = −20° $\omega_a - \epsilon_2$ = 50°

| | (1) | (2) | (3) | (4) | (5) | (6) |
|---|---|---|---|---|---|---|
| Am | 1.3 | 1.4 | 1.5 | 1.6 | 1.7 | 1.8 |

TABLE 4-continued

LF = 2.5 PX = 0.80 MR = 1.4 QK = 0.01 QL = 0.2 $L_1$ = 1.0
$L_2$ = 0.4 $L_3$ = 0.3 $\omega_{a0}$ = 50° $\epsilon_1$ = −20° $\omega_a - \epsilon_2$ = 50°

| | (1) | (2) | (3) | (4) | (5) | (6) |
|---|---|---|---|---|---|---|
| X | −0.313 | −0.342 | −0.375 | −0.411 | −0.450 | −0.492 |
| A | 0 | 0 | 0 | 0 | 0 | 0 |
| S | −0.154 | −0.100 | −0.055 | −0.016 | −0.019 | 0.050 |
| C | 1.213 | 1.300 | 1.384 | 1.466 | 1.548 | 1.631 |
| Y | −2.281 | −2.355 | −2.419 | −2.474 | −2.523 | −2.569 |
| B | −1.008 | −0.633 | −0.218 | 0.230 | 0.708 | 1.215 |
| X' | −0.977 | −0.909 | −0.843 | −0.782 | −0.725 | −0.674 |
| A' | −3.197 | −2.921 | −2.667 | −2.434 | −2.223 | −2.032 |
| S' | 1.379 | 1.170 | 1.002 | 0.865 | 0.752 | 0.658 |
| C' | 0.599 | 0.561 | 0.528 | 0.500 | 0.475 | 0.453 |
| Y' | −0.872 | −0.832 | −0.789 | −0.746 | −0.704 | −0.664 |
| B' | −0.823 | −0.648 | −0.485 | −0.335 | −0.199 | −0.075 |
| $L_f$ | 1.523 | 1.806 | 2.100 | 2.407 | 2.729 | 3.067 |
| $\omega_a$ | 39.8° | 37.4° | 35.2° | 33.3° | 31.6° | 30.1° |
| $\epsilon_2$ | −10.18° | −12.64° | −14.79° | −16.69° | −18.39° | −19.91° |
| $Y_1$ | −0.285 | −0.218 | −0.157 | −0.102 | −0.052 | −0.005 |
| $B_1$ | 1.021 | 1.208 | 1.376 | 1.528 | 1.666 | 1.791 |
| $Y_2$ | −0.953 | −0.853 | −0.761 | −0.678 | −0.602 | −0.532 |
| $B_2$ | 0.246 | 0.538 | 0.800 | 1.036 | 1.250 | 1.445 |

The numerical values of the components used in the calculations are as follows:

$L_1$: the distance between source slit and the quadrupole lens;

$Q_L$: the length of the quadrupole lens;

$Q_K$: the magnitude of the quadrupole lens;

$L_2$: the distance between the quadrupole lens and the Wien filter;

$L_F$: the length of the Wien filter;

$L_3$: the distance between the Wien filter and the entrance to the magnetic field;

$L_f$: the distance between the exit of the magnetic field and the focal plane;

$A_m$: the radius of circle described by ions in the magnetic field;

$\epsilon_1$: the incident angle of ions to the magnetic field;

$\epsilon_2$: the exit angle of ions from the magnetic field;

$\omega_a$: the angle of deflection of ions caused by the magnetic field.

All the lengths presented in Tables 1–4 are normalized so that the radius $A_{m0}$ of circle described by ions in the magnetic field may assume a value of unity. Said $A_{m0}$ is the radius of circle when the deflection angle $\omega_a$ equals to 50° ($=\omega_{a0}$).

As can be seen from FIG. 2, increasing the radius $A_m$ reduces the angle $\omega_a$ but increases the exit angle. In Tables 1–4, the sign of the exit angle $\epsilon_z$ is so set that the equation $\omega_a - \epsilon_2 = 50°$ holds.

The values of $Y_1$, $B_1$, $Y_2$, $B_2$ included in the tables are the coefficients of y and $\alpha_z$ when the y-coordinates of the ion beam at the entrance to the magnetic field and at the exit of the field are given by ($y_1$ y+$B_1$ $\alpha_z$) and ($y_2$ y+$B_2$ $\alpha_z$), respectively, provided that the beam passed through the source slit at position (y, $\alpha_z$). These values are used to estimate the convergence of ions regarding y-direction.

Figure 4:
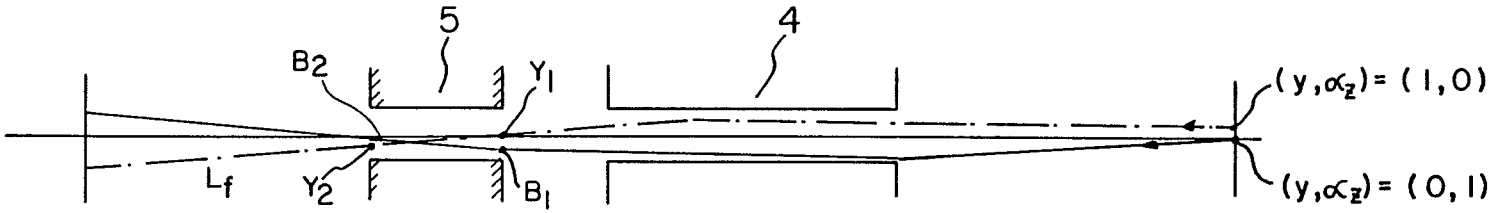
FIG. 4 is a diagram for illustrating the ion path as viewed along the vertical direction indicated by y in the spectrometer shown in FIG. 2.

FIG. 4 shows ion paths taken in y-direction in the spectrometer shown in FIG. 2. Ion beams $I_0$ and $I_1$ assume trajectories indicated by the solid line and the dot-and-dash line, respectively. At the position of the source slit, the beams $I_0$ and $I_1$ take positions (0, 1) and (1, 0), respectively. At the entrance to the magnetic field, the beams $I_0$ and $I_1$ take up positions $B_1$ and $Y_1$, respectively. At the exit of the field, they assume positions $B_2$ and $Y_2$, respectively.

The numerical values included in Tables 1–4 are computed using the differential equations $$d^2x/dz^2 = -K^2x \tag{6}$$

which describes the orbit of ions traveling through the Wien filter. Letting $F_M$ be the radius of curvature at which ions are deflected by the magnetic field in the Wien filter, the constant $K^2$ is given by $$K^2 = (1/F_M)^2 - P_x/F_M \tag{7}$$

For the set of numerical values listed in Table 1, further calculations were made to find the distance between the $\alpha$ focal plane and the $\beta$ focal plane along the ion path, the resolution R for an energy dispersion of 1%, the specific mass $M/M_0$ ($M_0$ is the mass at the double focusing point), and the mass number M, assuming that $M_0$=5000. The results are listed in Table 5.

TABLE 5

| | (1) | (2) | (3) | (4) | (5) | (6) |
|---|---|---|---|---|---|---|
| Am | 1.3 | 1.4 | 1.5 | 1.6 | 1.7 | 1.8 |
| S | −0.132 | −0.084 | −0.043 | −0.007 | 0.024 | 0.052 |
| C | 1.213 | 1.294 | 1.372 | 1.448 | 1.523 | 1.598 |
| δ | −0.088 | −0.066 | −0.039 | −0.007 | 0.029 | 0.072 |
| R | 919 | 1540 | 3190 | 20686 | 6346 | 3073 |
| M/Mo | 0.813 | 0.875 | 0.938 | 1.0 | 1.063 | 1.125 |
| M | 4062 | 4375 | 4687 | 5000 | 5312 | 5625 |

The distance δ included in Table 5 was calculated from the relation $$\delta = S/S' \tag{8}$$

The resolution R was calculated from the equation $$R = (C/S) \times 100 \tag{9}$$

on the assumption that the resolution is determined by the energy width, since the width of the source slit is sufficiently small.

In Table 5, the distance δ on the ion path (4) is nearly null at $A_m$=1.6. This means that the $\alpha$ focal plane and the $\beta$ focal plane intersect with each other in this path (4), thus satisfying the double-focusing condition.

We now assume that the mass of ions traveling through this path (4) is 5000, i.e., $M_0$=5000. Using the relationship $M/M_0 = A_m/1.6$, the masses M of ions passing through the other paths (1), (2), (3), (5), (6) were found to be 4,062, 4,375, 4,687, 5,312, 5,625, respectively.

Assuming that the length of the Wien filter is equal to 1 m, i.e., $L_F = 1$ m, we now calculate the radius of curvature $A_m$ at which ions transmitted through the path (4) are deflected within the magnetic field. Since $A_{m0} = L_F/2.7$ and $A_m = 1.6\ A_{m0}$, we have $$A_m = 59.3 \text{ cm}$$

The width $S_0$ of the source slit which attains a resolution of 5000 (R=5000) in the path (4) is calculated from $$X\ S_0 = A_{m0} C(1/R) \quad (10)$$

By substituting $X = -0.3538$, $C = 1.448$, $\gamma = 1/R = 1/5000$, and $A_{m0} = 1$ m/2.7 into equation (10), we get $$S_0 = 303\ \mu m$$

Figure 5:
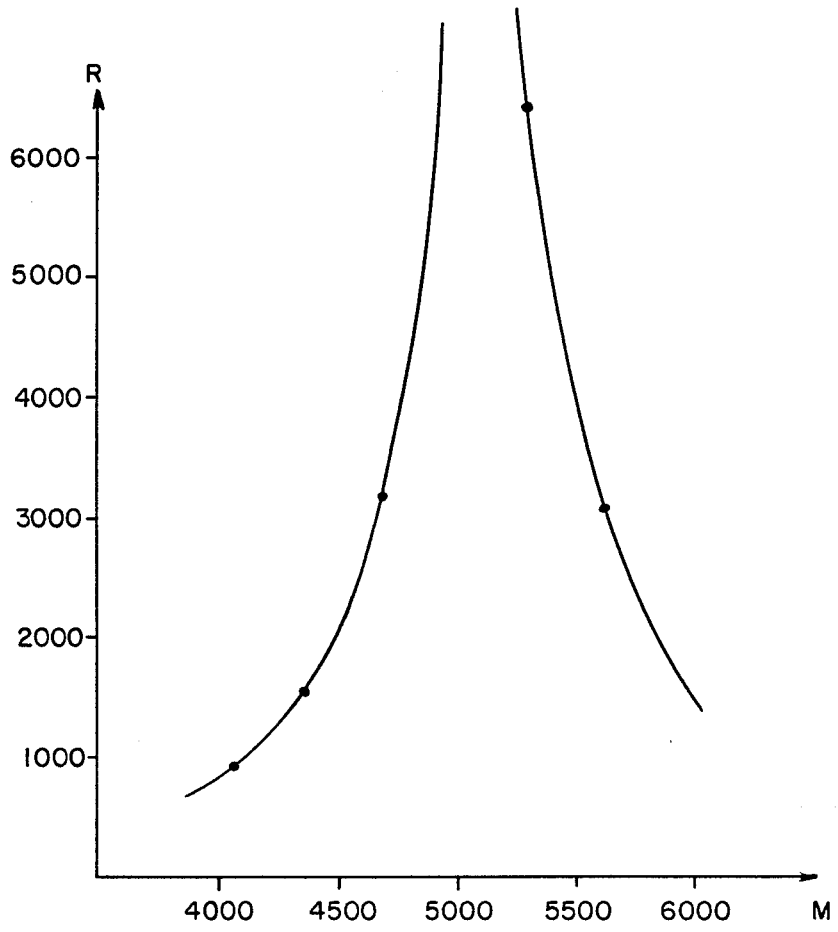
FIG. 5 is a graph in which the resolution R obtained by each path is plotted against the mass M of ions passing through the path.

FIG. 5 is a graph in which the resolution R obtained in the paths listed in Table 5 are plotted against the masses M of ions passing through the paths.

Figure 6:
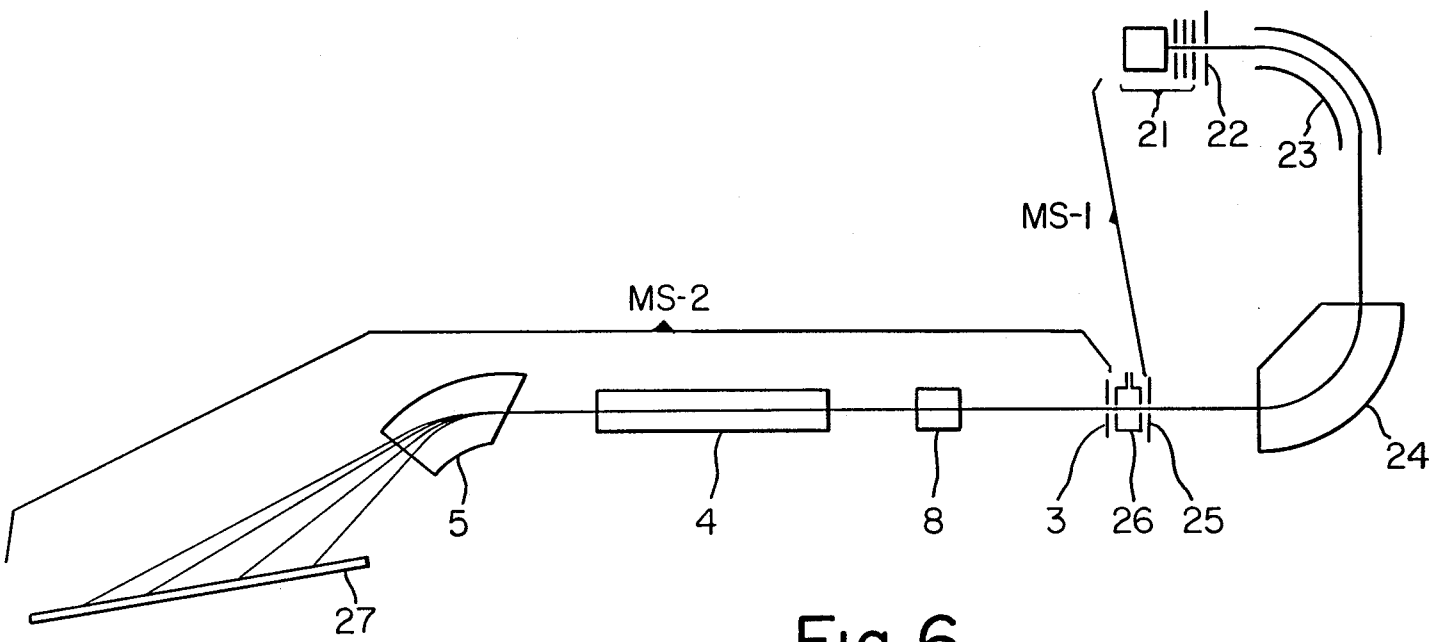
FIG. 6 is a schematic diagram of an instrument used in MS/MS method in accordance with the invention.

FIG. 6 shows the ion optical system of an instrument for effecting MS/MS in accordance with the invention. This instrument includes a first mass-selective device MS-1 consisting of an ordinary scan-type double-focusing mass spectrometer that comprises an ion source 21, a source slit 22, a cylindrical electric field 23, a magnetic sector 24, and a collector slit 25. A collision cell 26 is located behind the first device MS-1. A second mass-selective device MS-2 consisting of an ordinary double-focusing mass spectrometer as shown in FIG. 2 is placed behind the cell 26.

In the operation of the instrument shown in FIG. 6, the parent ions selected by the first mass-selective device MS-1 enter the collision cell 26 that is disposed behind the collector slit 25. In the cell 26 the parent ions collide with the collision gas and dissociate into daughter ions. The daughter ions are then passed into the second device MS-2 and dispersed according to mass to obtain a mass spectrum, and they are simultaneously detected by a detector 27. As described already, the daughter ions have a wide range of energies or masses but possess the same velocity. Therefore, by appropriately setting the Wien condition, all the daughter ions can pass through the Wien filter and are introduced into the second device MS-2 simultaneously. Accordingly, spectra of daughter ions can be provided over a wide range of masses by the second device MS-2. Further a high sensitivity can be accomplished because all the ions are detected simultaneously.

What is claimed is:

1. An instrument used in MS/MS method, comprising:

an ion source;

a first mass spectrometer into which ions produced from the ion source are introduced;

a means for dissociating the parent ions selected by the first mass spectrometer;

a Wien filter that receives daughter ions produced by dissociation of the parent ions;

a mass-selective magnetic field into which ions emerging from the filter pass; and a two-dimensional ion detector on which ions exiting from the magnetic field impinge, said detector being disposed along a plane where the double-focusing condition holds for a group of daughter ions having a range of masses and produced from parent ions of a certain ionic species.

2. The instrument of claim 1, wherein a quadrupole lens is disposed between the decomposing means and the Wien filter.

* * * * *

UNITED STATES PATENT AND TRADEMARK OFFICE

CERTIFICATE OF CORRECTION

PATENT NO. : 4,866,267

DATED : September 12, 1989

INVENTOR(S) : Hisashi Matsuda and Motohiro Naito

It is certified that error appears in the above-identified patent and that said Letters Patent is hereby corrected as shown below:

Column 3 Line 17 after "=0" start a new line with --V=--.

Column 4 Line 42 after "+" (last occurrence) insert --...--.

Column 4 Line 44 after "+" (last occurrence) insert --...--.

Column 5 Table 2 Line 2 "LE" should read --LF--.

Column 7 Line 50 " $\varepsilon_z$" should read -- $\varepsilon_2$--.

Signed and Sealed this

Eighteenth Day of September, 1990

*Attest:*

HARRY F. MANBECK, JR.

*Attesting Officer*

*Commissioner of Patents and Trademarks*